United States Patent [19]
Bock
[11] 4,318,336
[45] Mar. 9, 1982

[54] HYDRAULIC MOTOR

[76] Inventor: Rudolf Bock, Palmerstrasse 9, 7031 Holzgerlingen, Fed. Rep. of Germany

[21] Appl. No.: 143,307

[22] Filed: Apr. 24, 1980

[51] Int. Cl.[3] ..... F01B 1/06; F01B 13/06; F04B 1/10

[52] U.S. Cl. ..... 91/474; 91/490; 91/498

[58] Field of Search ..... 91/490, 491, 492, 498; 417/237, 270, 273

[56] References Cited

U.S. PATENT DOCUMENTS

| | | | |
|---|---|---|---|
| 1,243,494 | 10/1917 | Dunning | 91/498 X |
| 1,299,662 | 4/1919 | Beggs | 123/44 C |
| 2,938,504 | 5/1960 | Wadefelt | 91/498 |
| 3,046,950 | 7/1962 | Smith | 91/498 |
| 3,296,937 | 1/1967 | Guinot | 91/498 X |
| 3,403,599 | 10/1968 | Guinot | 91/491 X |
| 3,593,621 | 7/1971 | Praddaude | 91/498 |
| 3,808,951 | 5/1974 | Martin | 91/498 X |
| 4,178,885 | 12/1979 | Konther et al. | 123/44 C |

FOREIGN PATENT DOCUMENTS

| | | | |
|---|---|---|---|
| 1453538 | 3/1969 | Fed. Rep. of Germany | 91/498 |
| 1147679 | 6/1957 | France | 91/498 |

*Primary Examiner*—Michael Koczo, Jr.
*Attorney, Agent, or Firm*—Michael J. Striker

[57] ABSTRACT

A hydraulic motor has a stationary housing, a hollow rotor having a plurality of hollow radially extending pistons each provided with two concentric annular walls forming inner and outer chambers communicating with separate fluid-conveying passages, a plurality of cylinders displaceable over the pistons and each having a projection received in the inner chamber of the respective piston, and a central control member having a plurality of fluid-conveying passages cooperating with the fluid-conveying passages of the pistons and displaceable in the axial direction between a plurality of operating positions.

15 Claims, 10 Drawing Figures

HYDRAULIC MOTOR

BACKGROUND OF THE INVENTION

The present invention relates to a hydraulic motor.

More particularly it relates to a hydraulic motor which has a stationary housing, a rotor located in the housing and having a plurality of radially extending outwardly open hollow pistons, and a plurality of cylinders each moveable over a respective one of the rotors and having two journals cooperating with cam tracks provided in the housing.

Hydraulic motors of the above known general type are known in the art. One of such motors is disclosed, for example, in the British Patent No. 1242381. Hydraulic motors are also known in which for carrying out operations with full load or a partial load in each cylinder, stroke volume adjustment is provided. Such a hydraulic motor is disclosed, for example, in the German Offenlegungschrift No. 2331273. This hydraulic motor is compact, but has a very expensive construction with separable piston bottoms in connection with a rotatable valve block.

SUMMARY OF THE INVENTION

Accordingly, it is an object of the present invention to provide a hydraulic motor which avoids the disadvantages of the prior art.

More particularly, it is an object of the present invention to provide a compact hydraulic motor in which speed shift is attained by a simple adjustment of the stroke volume in each cylinder.

In keeping with these objects and with others, which will become apparent hereinafter, one feature of the present invention resides, briefly stated, in a hydraulic motor having a housing, a rotor including a plurality of radially outwardly open hollow pistons, and a plurality of cylinders movable over the pistons and each having two journals in contact with cam tracks of the housing, wherein each piston has two concentric annular walls forming a first chamber between the walls and a second chamber inside the inner wall each provided with a separate fluid conveying passage, each cylinder has cylindrical projection concentrically extending into the second chamber of the respective one of the pistons, and a control pin located inside the rotor has a plurality of axially spaced passages cooperating with the first mentioned passages of the chambers of the pistons and is displaceable in the axial direction between a plurality of operating positions.

When the hydraulic motor is designed in accordance with the present invention, it is favorable in the sense of its manufacture, has a high operational reliability, and provides for simple switch of the motor. These characteristics, in addition to the above-mentioned compact construction, are of a great importance when the hydraulic motor is utilized in vehicles exposed to vibrations, for example, when the motor is mounted in wheel hubs. The hydraulic motor in accordance with the invention provides for a shift between more than two speeds. In each shifting stage a symetrical load distribution on the rotor is maintained, which encounters difficulties in the radial piston motors wherein stepped shifting is performed by switching off of several pistons. A simple construction of the invented motor is attained both by the arrangement of the radial pistons with the cylinders and by the central control pin which displaces as a whole and is not formed of several parts. The stepped shifting of the motor is performed without difficulties by a remotely controlled axial displacement of the control pin, for example, by a pressure control valve arranged in a drainage conduit. Additional servo motors and the like for the control part are also not needed.

In accordance with another feature of the present invention, the rotor has an end wall which together with an adjacent end face of the control pin forms a pressure chamber for flowing in of a pressurized fluid so that the latter tends to displace the control pin in direction away of the end wall of the rotor against force of a return spring. At the same time, means for arresting the control pin in each of the above-mentioned operating positions is provided.

Still another feature of the present invention is that the annual walls of each of the hollow pistons are formed as separate parts and brazed to a tubular central part of the rotor, the central part being provided with the above-mentioned fluid conveying passages.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
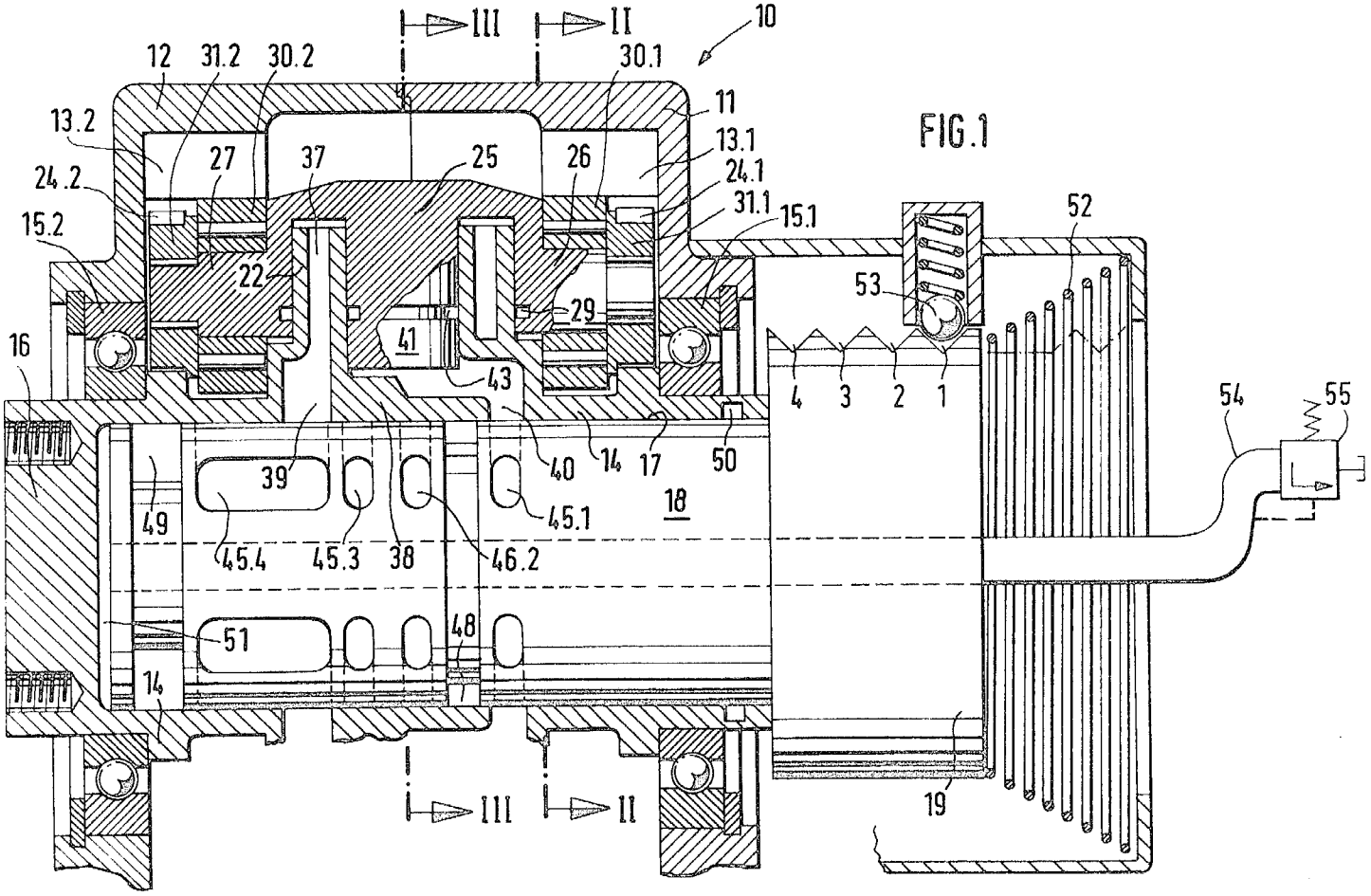
FIG. 1 is a view showing a longitudinal section of a hydraulic motor in accordance with the present invention.
Figure 2:
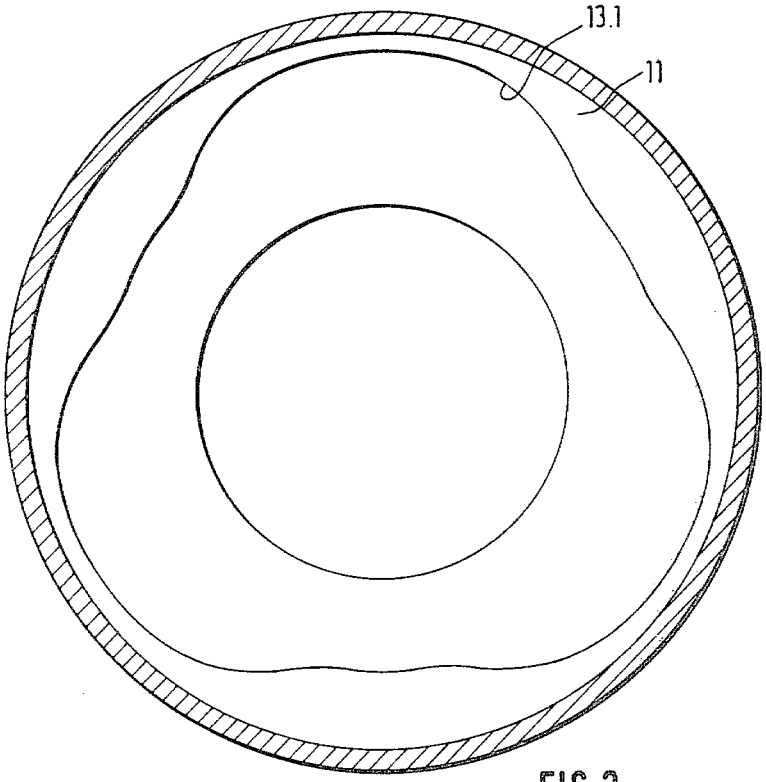
FIG. 2 is a view taken along the line II—II in FIG. 1, and showing one of cam tracks provided in a stationary housing of the inventive motor.
Figure 3:
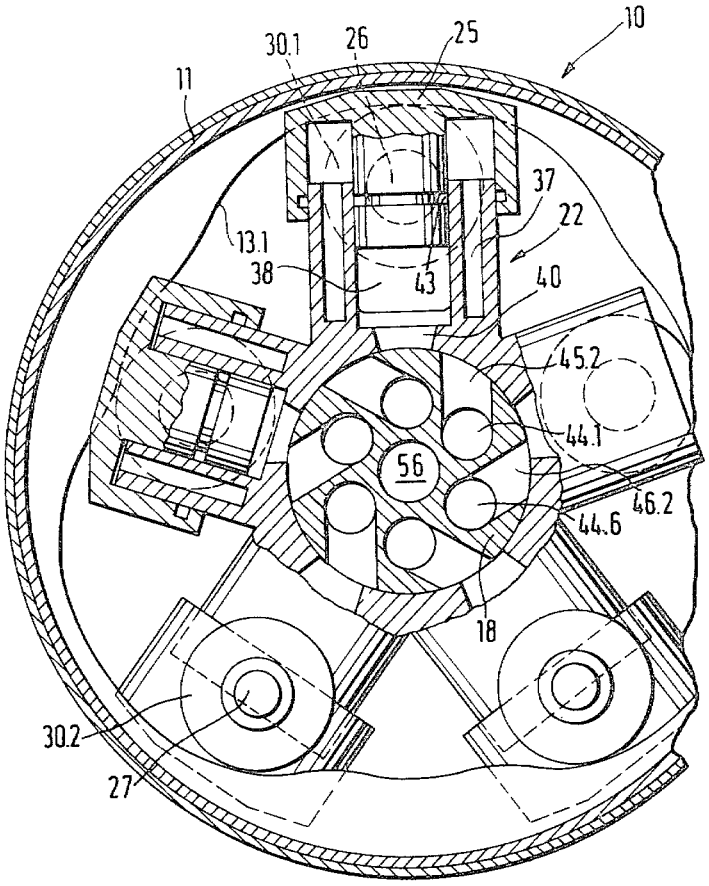
FIG. 3 is a view showing a section taken along the line III—III in FIG. 1.

A hydraulic motor in accordance with the present invention is identified in FIG. 1 by reference 10. It has a stationary housing composed of two identical cylindrical housing halves 11 and 12 provided with cam tracks 13.1 and 13.2.

The rotor 14 is supported in the housing by ball bearings 15.1 and 15.2, arranged in the respective housing halves 11 and 12. The rotor has a tubular central portion with an open end which is the right end, and a closed end which is the left end in the drawing. The closed end is formed by a flange wall 16. A not shown drive shaft can be coaxially flanged on the wall 16. A cylindrical control pin 18 extends through the open end of the rotor into the interior of the latter, more particularly into the central cylindrical recess 17. The control pin 18 has an enlarged outer connecting head 19 through which supply and discharge of pressurized medium for the hydraulic motor is performed.

Figure 4:
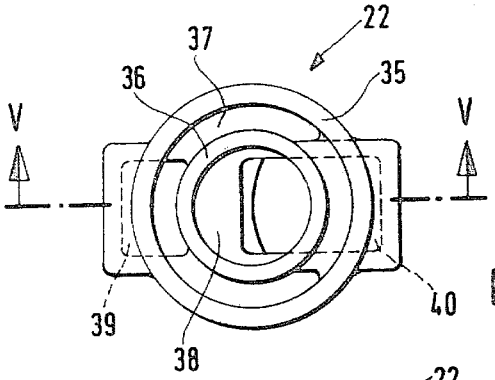
FIG. 4 is a plan view of one of pistons provided on a rotor of the inventive motor.
Figure 5:
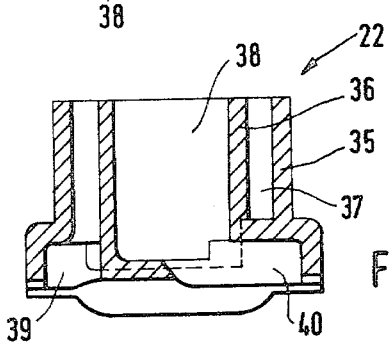
FIG. 5 is a view showing a section through the piston, taken along the line V—V in FIG. 4.

A plurality of hollow radial pistons 25 are arranged on the tubular central portion of the rotor 14 so that the pistons 22 extend radially and are spaced from one another in circumferential direction by equal distances. The radial pistons 22 can be manufactured as separate members and subsequently mounted on the tubular central portion of the rotor 14 by brazing. FIGS. 4 and 5 show a radial piston which is formed as a separate member to be mounted on the central portion of the rotor.

Each piston has two concentric annular walls including an outer annular wall 35 and the inner annular wall 36. The annular walls 35 and 36 together form two chambers which are open outwardly. The first chamber 37 is formed by an annular space between the concentric annular walls 35 and 36, whereas the second chamber 38 is formed inside the inner annular wall 36. The outer chamber 37 has an inner opening 39 and a corresponding opening in the tubular part of the rotor 14. The inner chamber 38 has an inner connecting opening 40 which is offset relative to the opening 39 in axial direction of the hydraulic motor 10.

Two radially extending cam elements are arranged on the outer sides of the rotor 13 symmetrically to the pistons arrangement and at equal distance from the latter. Each cam element is composed of a plurality of cam pieces 24.1 or 24.2. The cam pieces 24.1 and 24.2 of both cams are so formed that the intermediate spaces between the individual cam pieces have edges which are parallel to one another. This is not shown in the drawings for the sake of clarity.

Figure 6:
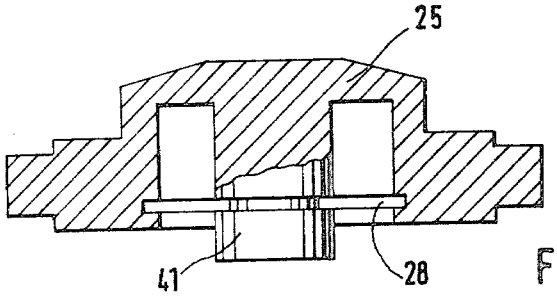
FIG. 6 is a view showing a central longitudinal section through a cylinder of the inventive motor.

One cylinder 25 cooperates with each radial piston 22 and is shown in FIG. 6. The cylinder 25 is cup-shaped and has two stepped journals 26 and 27 which extend radially relative to the axis of the cylinder. These journals are of one piece with the body of the cylinder. The cylinder has an annular groove 28 in which a small sealing ring 29 with small friction coefficient is received. The cup-shaped part of the cylinder has a concentric cylindrical piston projection 41. The projection 41 has an annular groove 43 formed at the height of the inner groove 28 and arranged for receiving a small sealing ring with small friction coefficient (FIG. 1). The projection 41 extends with a play into the cylindrical chamber 38 of the radial piston 22.

As can be seen from FIG. 1, control rollers 30.1 and 30.2 are arranged on the inner steps of the journals 26 and 27. The control rollers 30.1 and 30.2 abut against the cam tracks 13.1 and 13.2, respectively, of the stationary housing. Supporting rollers 31.1 and 31.2 are arranged on the outer steps of the journals 26 and 27 of each cylinder 25. The supporting rollers 31.1 and 31.2 extend in an intermediate space between two cam pieces 24.1 and 24.2 of both cams of the rotor 14 and abut against the parallel flanks of these cam pieces.

Tangential reaction forces acting from the cam tracks 13.1 and 13.2 onto the cylinder 25 rotating with the rotor 14 are not transmitted via the wall of the hollow radial piston 22, but via the supporting rollers 31.1 and 31.2 arranged on the journals 26 and 27, via the cam pieces 24.1 and 24.2 of the rotor, on which the cylinder 25 is supported in circumferential direction.

The small sealing ring 29 between the outer wall of the radial piston 22 and the surrounding cylinder 25 must act, however, for sealing and not for supporting purposes. Because of this, a relatively great play between the piston and the cylinder may be left whereby the tolerances of the cams and the supporting rollers 31.1 and 31.2 between the cam pieces 24.1 and 24.2 are allowed. Drainage of oil in the housing region located outside of the cylinder does not take place. The cylinder operates in extremely friction-free manner, especially because the rollers 30 and 31 are formed as ball-bearings or needle bearings.

Figure 7:
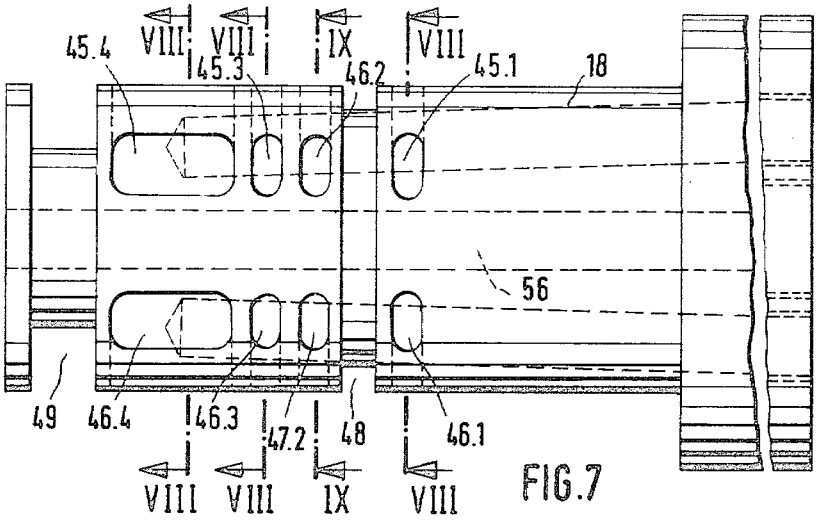
FIG. 7 is a view showing an axially displaceable control pin of the inventive motor.
Figure 8:
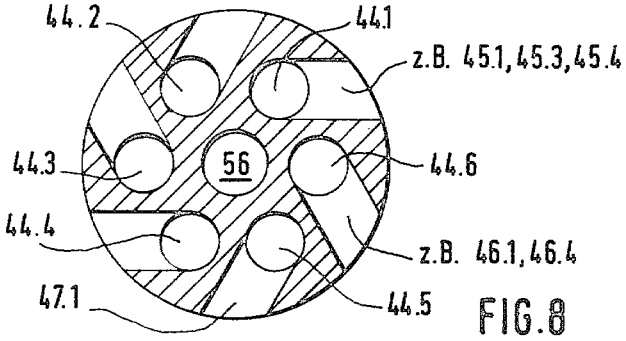
FIG. 8 is a view showing a section through the control pin, taken along the lines VIII—VIII in FIG. 7.
Figure 9:
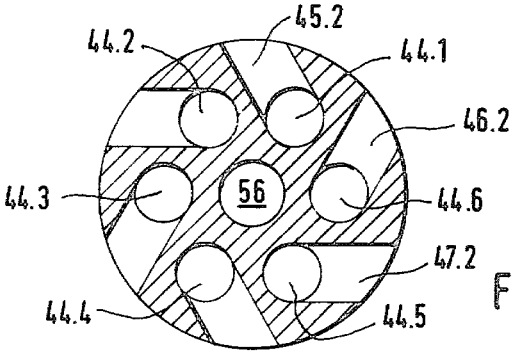
FIG. 9 is a view showing a section through the control pin, taken along the line IV—IV.

The control pin 18 of the motor 10 is displaceable in the axial direction between four different control positions and mounted so that it cannot rotate. As shown in FIGS. 7–9, the control pin has six inner longitudinal passages 44.1–44.6 and is provided, for each longitudinal passage, with four axially offset openings, for example, 45.1–45.4, 46.1–46.4 and 47.1–47.4. Moreover, the control pin 18 has two annular grooves 48 and 49. The openings of the same row of all six longitudinal passages 44 are located respectively in the same transverse plane, so that, including both annular grooves 48 and 49, six control places of the axial displaceable control pin 18 can be considered.

As shown in FIGS. 8 and 9, the three openings 45.1, 45.3 and 45.4 of the longitudinal passage 44.1 and the openings of the other longitudinal passages are in the same relative position so that these three openings have the same section in FIG. 8. In contrast to the above-mentioned openings, the second openings 45.2, and 46.2, 47.2 of all six longitudinal passages are in another relative position and offset on the periphery of the control pin 18 about one opening, so that they are located in the control plane as shown in FIG. 9. The longitudinal passages 44 are partially supply passages and partially discharge passages, in a known manner.

Figure 10:
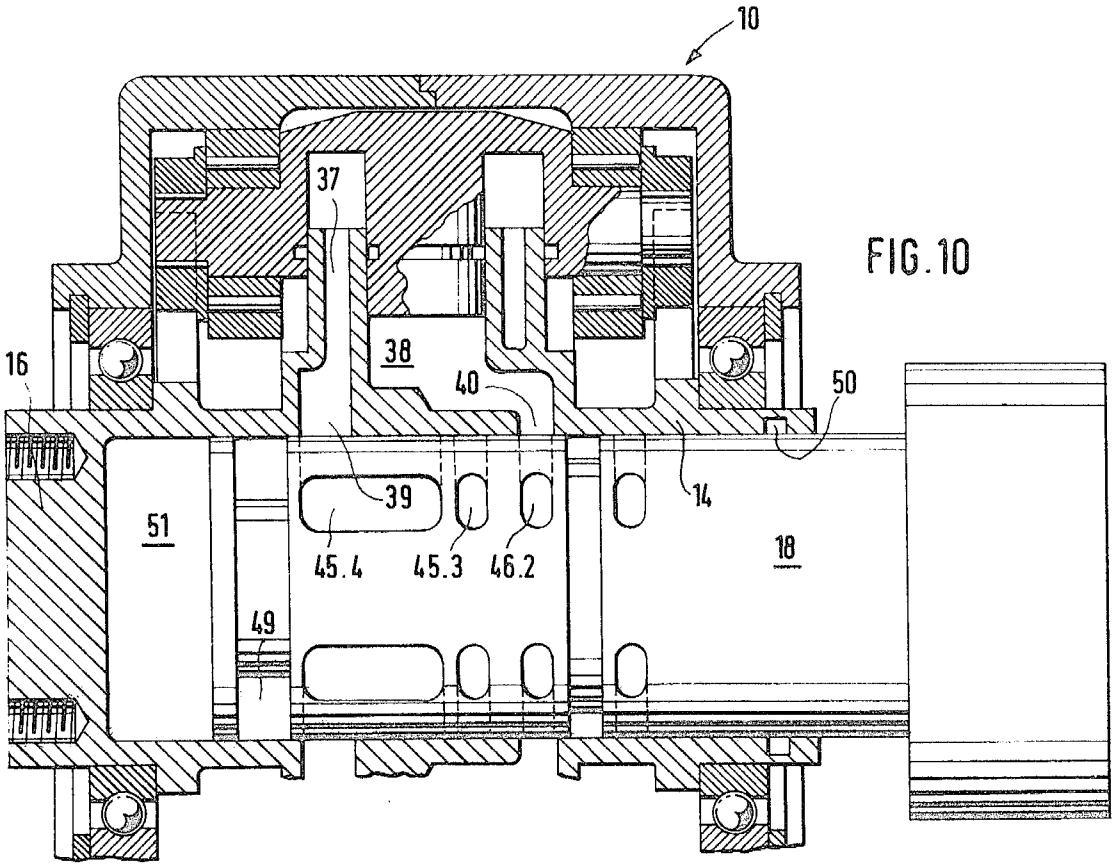
FIG. 10 is a view substantially corresponding to the view of FIG. 1, but showing a different position of the cylinder and the control pin of the inventive motor.

FIGS. 1 and 10 show two different control positions of the control pin 18. FIG. 1 shows the control pin 18 in its inner-most control position. In this position, the chambers 37 and 38 of the radial piston 22 communicate with the same longitudinal passages. In the piston shown in FIG. 1, the chamber 38 communicates via the inner opening 40 and the opening 45.1 of the control pin 18 with the longitudinal passage 44. The chamber 37 communicates via the inner opening 39 of the rotor 14 and the opening 45.4 of the control pin 18, also with the longitudinal passage 44.1. Thereby, the entire operating face of the cylinder 25 is under load, and the motor operates with a torque in the same direction with the full working capacity.

FIG. 10 shows the control pin 18 in its third of the four control positions, in which the piston chamber 37 communicates with the opening 45.4 and thereby with the longitudinal passage 45.1, whereas the piston chamber 38 communicates with the opening 46.2 and thereby with the adjacent longitudinal channel 44.6 of the control pin 18. This means that one piston chamber is connected with a pressure conduit, whereas the other piston chamber is connected with a suction conduit. Since the piston and cylinder are connected with one another in force-locking member, it is possible that the projection 41 of the cylinder 25 operates as a pump. The operative cross section of the piston chamber 38 acts against the operative annular cross section of the piston chamber 37.

It can be easily concluded from FIGS. 1 and 10, that when the control pin assumes a not shown position between the position of FIGS. 1 and 10, the chamber 37 of the radial piston 22 communicates via the elongated opening 45.4 of the control pin 18 with the longitudinal passage 44.1, whereas the chambers 48 of all radial pistons communicate via the annular groove 48 with one another and thereby are practically short-circuited. The cylinder is subjected to load only over a part of its operative face.

The same situation takes place in the fourth control position of the control pin 18 when the chambers 37 of all radial pistons are short-circuited via the annular groove 49 of the control pin, and the chamber 38 of the shown radial piston communicates via the opening 45.3 of the control pin 18 with the longitudinal passage 44.1.

The gap between the rotor 14 and control pin 18 in the vicinity of the rotor opening is sealed by a sealing ring 50. Drainage oil on the periphery of the control pin 18 cannot thereby flow outwardly. The drainage oil can travel into an intermediate space 51 between the flange wall 16 of the rotor and an inner end face of the control pin 18. As can be seen from FIG. 1, the control pin which cannot rotate is spring-biased by a spring 52 so that the control pin is pressed to the first control position shown in FIG. 1. The displacement of the control pin 18 to the control positions 2 and 3 is performed under the action of drainage oil flowing into the intermediate space 51. Pressure which thereby develops in the intermediate space 51 acts upon the entire area of the end face 18.

The control pin 18 can be arrested in each of the control positions by a spring-biased arresting ball 53 engageable in respective arresting notches 1, 2, 3, and 4. The oil pressure developed in the intermediate space 51 is controlled by a schematically shown adjustable pressure control valve 55 located in a flexible drainage oil conduit 54 extending in drainage direction. The drainage oil conduit 54 communicates with the intermediate space 51 of the motor via a central longitudinal passage 56. When the control pin 18 has a large end face area, a small change of the oil pressure suffices for attaining a sufficiently great change of pushing force acting upon the control pin. Thereby sufficiently great force is guaranteed for axial displacement of the control pin 18 from an arrested position into a next position against the force of the pressure spring 52 and an exact shift of the motor.

In the fourth control position and end position, the control pin 18 can be additionally held by an abutment. The holding force of the spring-biased arresting formations is such that its arresting action is first overcome by a pressure increase in the intermediate space 51, which provides for a force change sufficient to displace the control pin 18 against the force of the pressure spring 52 to the next arresting position.

The control pin may have other constructions providing for other control operations. For example, the control pin may be formed so as to have only two or three control steps or a slow working stroke in forward direction and a rapid return stroke. When the operative cross-section of the piston chamber 38 and the respective section of the projection 41 of the cylinder 25 have an area corresponding to one fourth of the total operative face of the cylinder, the following progression is obtained from the first to the fourth control step of the control pin 18: starting from the face value of four available in the first control step and corresponding to the fully operating cylinder face, the second control step will have the face value of three, the third control step will have the face value of two, and the fourth control step will have the face value of 1. In condition of constant amount of the supplied pressure oil, the following speed value is obtained starting from the speed value 1 in the first control step: in the second control step the speed is 1.33 times of the value 1, in the third control step the speed is double of the value 1, and in the fourth control step the speed is 4 times of the value 1.

It will be understood that each of the elements described above, or two or more together, may also find a useful application in other types of construction differing from the types described above.

While the invention has been illustrated and described as embodied in a hydraulic motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic motor, comprising a stationary housing having two cam tracks spaced from one another; a hollow rotor in said housing and rotatable about an axis, said rotor having a plurality of hollow radially extending pistons spaced from one another in a circumferential direction and each having two concentric annular walls forming a first chamber bounded between said annular walls and a second chamber bounded inside an inner wall of said walls, each of said pistons having two separate fluid-conveying passages spaced from one another in an axial direction and each communicating with a respective one of said chambers; a plurality of cylinders in said housing spaced from one another in the circumferential direction and arranged to displace said hollow pistons, each of said cylinders having two journals extending oppositely in the axial direction and arranged to cooperate with said cam tracks of said housing, and a radial projection received in said second chamber of a respective one of said pistons; and a central control member located in said rotor concentric to the latter and displaceable in the axial direction between a plurality of operating positions, said control number having a plurality of further fluid-conveying passages spaced from one another in the axial direction and cooperating with said first-mentioned fluid-conveying passages of said pistons.

2. A hydraulic motor as defined in claim 1, wherein said projection of each of said cylinders is cylindrical and is fittingly received in said second chamber of a respective one of said pistons.

3. A hydraulic motor as defined in claim 1, wherein each of said cylinders has a cup-shaped body part with two axially spaced ends, each of said journals being provided at a respective one of said axially spaced ends.

4. A hydraulic motor as defined in claim 1, wherein said walls of each of said pistons extend and said chambers formed by said walls of each of said pistons are open radially outwardly, each of said cylinder having a further annular chamber which is open radially inwardly and receives said walls of a respective one of said pistons.

5. A hydraulic motor as defined in claim 1; and further comprising a plurality of rollers arranged on said journals of each of said cylinders and being in guiding contact with a respective one of said cam tracks of said housing so as to provide for the cooperation between said cam tracks and said journals.

6. A hydraulic motor as defined in claim 1, wherein said rotor has a cylindrical passage, said control member being formed by a cylindrical pin axially movably received in said passage.

7. A hydraulic motor as defined in claim 1, wherein said rotor has an inner passage having two axial ends, one of said axial end of said rotor being open so that said control member passes through said one axial end and extends into said inner passage of said rotor, the other of said axial ends of said rotor being closed by an end wall, said control member having an end face facing toward said end wall and together with the latter bounding a pressure chamber into which a pressurized fluid can flow so as to displace said control member in the axial direction away of said end wall of rotor.

8. A hydraulic motor as defined in claim 7; and further comprising resilient means arranged to urge said control member in direction toward said end wall of said rotor, so that when said control member displaces in the direction away of said end wall under the action of the pressurized fluid in said pressure chamber, it displaces against the force of said resilient means.

9. A hydraulic motor as defined in claim 8, wherein said control member has a first end portion forming said end face and a second end portion axially spaced from said first end portion, said resilient means including a return spring acting upon said second end portion of said control member.

10. A hydraulic motor as defined in claim 7; and further comprising means for arresting said control member in each of said operating positions.

11. A hydraulic motor as defined in claim 10, wherein said arresting means includes a first formation arranged on said housing and a second formation arranged on said control member and releasably engageable with the first formation in a respective one of said operative positions, one of said formations being a spring-biased ball whereas the other of said formations is a plurality of notches spaced from one another in the axial direction.

12. A hydraulic motor as defined in claim 10, wherein said arresting means includes a plurality of abutments.

13. A hydraulic motor as defined in claim 1, wherein said walls of each of said pistons are formed as a separate wall part, said rotor having a tubular central portion provided with said first-mentioned fluid-conveying openings, said separate wall part being fixedly connected with said central portion of said rotor.

14. A hydraulic motor as defined in claim 13, wherein said separate wall part is brazed on said central portion of said rotor.

15. A hydraulic motor as defined in claim 1, wherein said control member is a one-piece member and displaces as a whole between said operating positions.

* * * * *